United States Patent [19]

Mead et al.

[11] 4,092,240

[45] May 30, 1978

[54] REFRIGERATION OIL PROCESSING

[75] Inventors: Theodore C. Mead, Port Neches; Avilino Sequeira, Jr., Port Arthur; Norman R. Odell, Nederland, all of Tex.

[73] Assignee: Texaco Inc., New York, N.Y.

[21] Appl. No.: 811,333

[22] Filed: Jun. 29, 1977

[51] Int. Cl.[2] ..... C10G 25/00

[52] U.S. Cl. ..... 208/301; 208/3; 208/229; 208/286

[58] Field of Search ..... 208/301, 283, 229, 231, 208/286, 299, 304, 3

[56] References Cited

U.S. PATENT DOCUMENTS

| | | | |
|---|---|---|---|
| 2,230,274 | 2/1941 | Soday | 208/286 |
| 2,776,309 | 1/1957 | Nelson | 208/14 |
| 2,978,472 | 4/1961 | Kirkwood et al. | 208/3 |
| 3,223,748 | 12/1965 | Bohrer | 208/299 |
| 3,725,253 | 4/1973 | Yamada | 208/211 |
| 3,830,730 | 8/1974 | Mead et al. | 208/87 |

*Primary Examiner*—George Crasanakis

*Attorney, Agent, or Firm*—Carl G. Ries; Thomas H. Whaley; Kenneth R. Priem

[57] ABSTRACT

A refrigeration oil processing sequence is disclosed which produces a superior oil without the use of sulfuric acid treating and the resultant sludge problems. The process comprises contacting a naphthenic based oil with an oxygen-containing gas in the presence of a permanganate under mild oxidation conditions of temperature and pressure followed by adsorbent fractionation.

8 Claims, No Drawings

REFRIGERATION OIL PROCESSING

BACKGROUND OF THE INVENTION

Field of the Invention

This invention pertains to the field of processing refrigeration oils.

Heretofore refrigeration oils with acceptable properties have been produced by various methods which usually included sulfuric acid treating and solvent refining. However, sulfuric acid treating is not preferred since it produces large amounts of sludge which must be disposed of. Environmental considerations demand that processes be developed which eliminate this sludge problem. In the present invention, a preoxidation step is used which, when used in combination with adsorbent fractionation, produces an oil having superior properties necessary for refrigeration oils. U.S. Pat. No. 3,725,253 discloses a process for the purification of lubricating oils which comprises first reacting the mineral oil with an oxygen containing gas catalytically at temperatures ranging from 180° to 280° C. This severe process results in the destruction of a large percentage of the incoming charge stock and consequent massive sludge formation. Thus, vacuum distillation is required to remove the compounds produced in the oxidation step. The process of the patent is completely different from the process of the present invention since the preoxidation step in the present invention is carried out at a much lower temperature resulting in almost no impurity generation. As a consequence, vacuum distillation is not required at the end of the oxidation step in the present process. Thus, it is clear that the patent is directed to a completely different process which has as its aim a completely different objective and achieves different results than this invention.

U.S. Pat. No. 3,105,812 describes a process for removing nitrogen-containing compounds from cracking and hydrocracking feed stocks by catalytic oxidation followed by hydrogenation. The oxidation is catalyzed by phosphorous oxide or a phosphorous oxide and vanadium oxide mixture. As the patent points out, the vanadium oxide catalyst, which is a relatively well known oxidation catalyst, is not very effective used alone. Although the claims of the patent include a temperature between 100° and 600° F for the oxidation step, the examples given in the patent were carried out at from 300° to 400° F. It has been found in using the process of our invention that oxidation of refrigeration oil stocks can be carried out at a much lower temperature rountinely. This is surprising in view of the data in U.S. Pat. No. 3,105,812. At column 10, lines 51–59 the patent teaches that a charge stock boiling in the range of a typical refrigeration oil distillate (565°–810° F) is best hydrogenated at 800–1600 psi. Using the process of our invention, the hydrogenation pressure is much lower.

The invention to be disclosed below uses a unique catalyst system for preoxidizing a refrigeration oil feed stock at very mild conditions. The fact that this can be done is surprising from the prior art which teaches oxidation of hydrocarbon oil feed stocks at much more severe conditions. The mild conditions to be delineated below have very real advantages in fuel savings, required metallurgy, and capital investments as well as other considerations.

SUMMARY OF THE INVENTION

The invention comprises first treating a suitable naphthenic refrigeration oil charge stock by catalytic oxidation at a temperature below about 275° F and at pressure ranging up to about 300 psi in the presence of a catalytic quantity of an alkali or alkaline earth metal permanganate and then subjecting the oil to adsorbent fractionation.

DESCRIPTION OF THE PREFERRED EMBODIMENTS

Examples of suitable hydrocarbon oil charge stocks for the process of this invention are those naphthenic crudes which typically boil in the range of 250° to 500° C and have viscosities in the range of 50 to 650 SUS, preferably 70 to 500 SUS at 100° F. It is also possible to obtain refrigeration oils from crudes with viscosities as low as 30 and as high as 750 SUS at 100° F. The refrigeration oil stocks are initially obtained from the distillation of crude naphthenic petroleum. The stock may be obtained as overhead from a vacuum distillation or may be obtained from the residue of vacuum distillation by deasphalting the residue by contact, for example, with a deasphalting agent such as propane, butane and the like or mixtures thereof.

Oxidation

There are present in unprocessed lubricating oils molecular structural types which are particularly susceptible to oxidation and thermal and chemical degradation. These types include olefins, nitrogenous compounds, other compounds containing heteroatoms, certain types of aromatics and others. If allowed to remain in refrigeration oils, oxidation products of these species are polar or acidic in nature and tend to degrade the properties of refrigeration oils. Sulfuric acid treating has in the past removed such oxidizable species. This invention will show that oxidizing conditions, not involving the use of sulfuric acid, can oxidize susceptible molecular types. The oxidates thus formed can then be removed or rendered innocuous by other processing steps to be pointed out herebelow.

The oxidation step is carried out catalytically with an alkali or alkaline earth metal permanganate being the preferred catalyst. Especially preferred is potassium permanganate. Operable concentration range of the catalyst is from 0.01 to 5.0 weight percent basis oil. Catalysts may be used in solid form in which case the optimum range is from 0.5 to 5 weight percent. The catalyst may be added as a dilute aqueous solution in which case the preferred concentration is from 0.01 to 0.5 weight percent.

Alternatively, other alkali or alkaline earth metal salts or permanganate may be used, as may alkali or alkaline earth metal salts of other multivalent metals (particularly dichromate) provided that the metal is in a higher oxidation state.

The temperature at which the oxidation step should be performed is from ambient temperature to about 275° F. The preferred range is from about 150° to 275° F. This temperature may vary depending on the rate at which air is fed into the reactant mixture. However, the oxidation termperature is a function of the exothermic temperature of the reaction and generally does not require external heating. It is preferred to adjust the air dosage rates so that the heat generated by the oxidation is just sufficient to maintain the required mild reaction temperature.

The operable pressure for the oxidation reaction is up to about 300 psi. It is preferred to operate at about atmospheric pressure if possible. The dosage rate of oxidizing gas (oxygen) is from about 0.01 to 5.0 SCF per minute per kilogram of oil. However, this dosage rate will depend on the concentration of inert diluent in the oxidizing gas, and the desired operating temperature as well as other operating variables. It is preferred to use from about 0.01 to 3.0 SCF per minute per kilogram of oil when possible.

The oxidizing gas may be chosen from the group consisting of air, oxygen, ozone, nitrogen oxides and combinations of these with addition of inert diluents such as nitrogen. It is preferred to use air and oxygen-nitrogen mixtures whenever possible.

Clay Fractionation

Adsorbent fractionation is a completely different process than the better known clay percolation. Clay percolation of course, comprises contacting clay or other adsorbent with the oil to be treated at a rapid rate. That is, the oil passes through the adsorbent rapidly. No solvent for the oil is used so the product directly from the clay percolation column is ready for testing and use without further processing. The yield is about 98+ percent.

Adsorbent fractionation, however, results in chromatographic separation of the bulk of the oil into large fractions based on the relative polarity (absorbtivity) of the major components of the oil, i.e., aromatics versus naphthenes and paraffin. Clay percolation also involves some chromatographic separation but because of the high ratio of oil to charge used, only small quantities of the most polar materials, i.e., impurities such as nitrogen, oxygen and sulfur containing compounds are removed.

In a typical adsorbent fractionation process, a column is filled with a solvent such as cyclohexane. Then, for example, reburnt Porocel (bauxite) which has been calcined at about 900° F and sieved to 30–60 mesh is slowly added to the column and allowed to soak in the cyclohexane so that the clay will be saturated with cyclohexane. The clay fills the column to the base of the reservoir. Excess cyclohexane is then drawn from the column and discarded but the clay is kept covered with cyclohexane. The column is then ready for the fractionation process. In a typical fractionation process, one part of oil would be dissolved in about one and one half parts of cyclohexane and the solution would be placed in a column reservoir and a liquid level drawn down to the top of the clay. The solution drawn off in this step would be retained as the first eluate fraction. At this stage of the process a major portion of the oil is adsorbed onto the clay. The reservoir is then filled with cyclohexane and liquid is drawn off the bottom of the column. As the liquid drops, more cyclohexane is added to the reservoir until the desired fraction of charge oil is eluted. The reservoir is never allowed to run dry. The solvent, cyclohexane for example, is then separated by known processes such as vacuum distillation from the oil. In a typical adsorbent fractionation process, a yield of about 60–90 percent oil is obtained with about 80 percent being more typical. Residual oil in the column may be removed by passing a stringent solvent such as methyl ethyl ketone through the column.

The adsorbents used in adsorbent fractionation may be bauxite and other clays as well as calcined bauxite, alumina oxide, silicon oxide, clay, bentonite, diatomaceous earth, Fuller's earth, bone char, charcoal, magnesium silicate, activated Kaolin, silica-alumina and zeolites. It is preferred to use calcined bauxite, a commercial version sold under the trade name "Porocel." The adsorbent will normally have a mesh size (U.S. Standard) of between about 20 and 200.

The temperature during adsorbent fractionation should range between 50° and 300° F. The weight ratio of adsorbent to charge oil is between about 10:1 to 1:1. The weight ratio of solvent to oil should be between about 50:1 to 1:1.

A description of adsorbent fractionation is embodied in U.S. Pat. No. 3,830,730 which is incorporated herein by reference.

In conventional processing of refrigeration oils, a dewaxing step (either complex or solvent dewaxing) is ordinarily incorporated in the processing sequence. The enumeration of the new steps of oxidation and adsorbent fractionation does not preclude the necessity of conventional dewaxing. Thus, an example of the overall process for the preparation of refrigeration oils is: oxidation, adsorbent fractionation, complex dewaxing, and clay straining to remove "fines" from urea dewaxing. Another example is: oxidation, complex dewaxing, and adsorbent fractionation. Since conventional steps are old in the art they will not be discussed further.

Illustrative Example

A naphthenic distillate of 80 SUS 100° F viscosity (1000 g), solid potassium permanganate (25 g) and sulfuric acid (1 ml) were blown with air (0.45 SCF/min) for 3 hours at 200° F at atmospheric pressure. Reaction product was washed twice with 500 ml portions of water; washings were discarded. Product oil (871 g; 87.1 wt% yield) was filtered from traces of inorganic residue.

The oxidized product above (500 g) was dissolved in sufficient cyclohexane to make up 1000 ml of solution. Oxidate-cyclohexane solution was placed on a column one meter in height containing one kilogram of 30–60 mesh bauxite (commercial product "Porocel"). The solution was removed from the column bottom at a rate of 10 ml/min (3.42 BPT/hr); a total of 1700 ml of eluate solution was collected in this manner, fresh cyclohexane being added to the column top reservoir at appropriate intervals. Solvent cyclohexane was removed under reduced pressure to afford 423 g product. This corresponds to an 84.3 weight percent yield across the clay fractionation step and a 74.3 weight percent yield across both steps of the process.

Residual oil was stripped from the porocel column by flushing the column with one liter of methyl ethyl ketone; both residual oil and ketone were recovered via distillation of ketone. After a second wash with one liter of methyl ethyl ketone, the porocel column was allowed to air dry; it was then ready for reuse.

Determination of Product Stability

One generally recognized method of determining the chemical stability of refrigeration oils is by means of the "Elsey" test. In this method, equal volumes of oil and Freon® R-12 are placed in a sealed tube in the presence of iron and copper. The tubes are heated to 347° F for extended periods (14 days in the present example) and rate of color formation observed; a color scale of 0–10 is used with 0 representing a water-white oil and 10 a black oil. At the conclusion of a 14-day test period Freon-12 may be analyzed for Freon 22. The presence of significant quantities of Freon 22 is taken as evidence that the lubricant, by virtue of its chemical instability, is contributing to the instability of the refrigerant. That is, low Freon 22 analyses are indicative of a good refrigeration oil, with reference to chemical stability. Two samples each of the naphthenic stock, conventionally processed (i.e., solvent refined - acid treated) refrigeration oil, and the experimental oil prepared as described in the preceding section were submitted for "Elsey" testing. Rate of color formation and results of Freon-22 analysis are indicated in Table I.

TABLE I

STABILITY TESTING OF CONVENTIONAL AND EXPERIMENTAL REFRIGERATION OILS

| Oil | Untreated 80 SUS (at 100° F) naphthene oil | | Acid-treated refrigeration oil[1] | | Experimental oil | |
|---|---|---|---|---|---|---|
| Sample # | 1 | 2 | 1 | 2 | 1 | 2 |
| Color after day 1 | 6 | 7 | 1 | 1 | 0 | 0 |
| 2 | 7 | 8 | 1 | 1 | 0 | 0 |
| 3 | 8 | 8 | 1 | 1 | 0 | 0 |
| 4 | (not further tested) | | 1 | 1 | 0 | 0 |
| 10 | — | — | 1 | 1 | 1 | 1 |
| 14 | — | — | 1 | 1 | 1 | 2 |
| After 14 days Freon 12, wt% | | | 99.79 | 99.64 | 99.90 | 99.82 |
| Freon 22, wt % | | | 0.21 | 0.36 | 0.10 | 0.18 |

[1]Sulfur dioxide refined at 85 vol % dosage and 60° F; sulfuric acid treated at 50 barrels per ton, caustic washed, brightened, complex dewaxed and clay strained.

We claim:

1. A method of making refrigeration oils comprising:
(a) contacting a naphthene oil with an oxygen-containing gas selected from the group consisting of air, oxygen, ozone, nitrogen oxides, and mixtures thereof, and with a catalyst comprising an alkali or alkaline earth metal salt of permanganate at a temperature below 275° F and a pressure ranging up to about 300 psi,
(b) introducing the oil separated from step (a) into the upper portion of a fixed bed adsorbent and adsorbing said oil on said adsorbent
(c) eluting said adsorbent with a solvent to elute from said adsorbent and eluate oil fraction, and
(d) separating said solvent from said eluate oil fraction to recover a refrigeration oil product.

2. A method as in claim 1 wherein the temperature in step (a) is between about 150° to 275° F.

3. A method as in claim 1 wherein the pressure in step (b) is from about atmospheric to 300 psi.

4. A method as in claim 1 wherein the pressure in step (a) is about atmospheric.

5. A method as in claim 1 wherein the oxygen-containing gas is air.

6. A method as in claim 1 wherein the catalyst in step (a) is potassium permanganate.

7. A method as in claim 1 wherein the yield of oil from step (b) is between 60 to 90 percent.

8. A method of making refrigeration oils comprising:
(a) contacting a naphthene oil with air and with a catalyst comprising an alkali metal salt of permanganate at a temperature ranging between 150° and 275° F and a pressure of from about atmospheric to 300 psi,
(b) introducing the oil separated from step (a) into the upper portion of a fixed bed adsorbent and adsorbing said oil on said adsorbent
(c) eluting said adsorbent with a solvent to elute from said adsorbent an eluate oil fraction of between 60 and 90 percent of the oil introduce onto said fixed bed adsorbent, and
(d) separating said solvent from said eluate oil fraction to rocover a refrigeration oil product.

* * * * *